United States Patent [19]

Perego et al.

[11] Patent Number: 4,462,326

[45] Date of Patent: Jul. 31, 1984

[54] TAPE FEED DRIVE FOR SEWING MACHINES

[75] Inventors: Giuseppe Perego; Adelmo Garagiola, both of Milan, Italy

[73] Assignee: Rockwell-Rimoldi S.p.A., Italy

[21] Appl. No.: 450,938

[22] Filed: Dec. 20, 1982

[30] Foreign Application Priority Data

Mar. 26, 1982 [IT] Italy ..... 20416 A/82

[51] Int. Cl.[3] ..... D05B 27/10

[52] U.S. Cl. ..... 112/318; 112/121.27

[58] Field of Search ..... 112/318, 322, 314, 307, 112/303, 121.26, 121.27, 121.11, 2, 152; 226/42; 242/55

[56] References Cited

U.S. PATENT DOCUMENTS 4,147,120 4/1979 Adamski, Jr. et al. ..... 112/318

4,389,951 6/1983 Von Hagen ..... 112/121.27

*Primary Examiner*—Peter P. Nerbun

[57] ABSTRACT

A device for feeding tape, elastic strips or the like in a sewing machine that functions in timed relation with the mechanism for advancing a workpiece during seaming. The device includes elements for sensing the machine's operating speed and the amount of workpiece advance during each revolution of the machine's main shaft. A control unit having a microprocessor is operatively connected to the sensing elements and is effective in controlling a motor associated with the feed rollers for the tapes etc. so that they are rotated by an amount governed by the control unit. A feed back response to the control unit provides the information on roller rotation so that a comparison can be made with information previously received whereby the control unit is capable of initiating a correction for possible differences that may exist when the actual rotational speed of the rollers is greater or less than that required for the desired manner of application of tape or elastic strips to a workpiece.

6 Claims, 2 Drawing Figures

TAPE FEED DRIVE FOR SEWING MACHINES

BACKGROUND OF THE INVENTION

The invention pertains to sewing machines and, more especially, to a device for feeding tapes, elastic strips or the like (hereinafter referred to as "tapes") for attachment to a workpiece in timed relation to the latter's advance along the machine's work surface during the sewing cycle.

The intended function of the device is that of controlling the feed of tape to the workpiece in timed sequence to the operating speed of a sewing machine and, depending on the requirements thereof, the tapes can be fed in an amount equal to or less than the amount of advance of the workpiece by the machine's conventional transport mechanism. The supply of tape is equal to the amount of advance of the workpiece when it is intended to be attached thereto without pre-tensioning and in a lesser amount if it is intended to pleat the workpiece during the stitching operation.

The device includes a motor member with control and command elements associated therewith whereby the tape feed rollers can be synchronized with the operating speed of the machine and for effecting necessary changes thereto to compensate for any variation in the operating speeds of the machine.

If the machine could be operated continuously at a constant speed, the device, according to the invention, would not be necessary; however, as the operating speed is never constant due to the ever present inertia of mechanical elements, and, with the lack of such a device, there is no means for effecting automatic adjustment of the tape feed to compensate for changes in the machine's operating speed. Such a condition creates an undesirable tensioning buildup during machine acceleration and with an excessive amount of tape being present during deceleration.

In known sewing machines these discrepancies due to inertia are quite obvious for when the machine is accelerating the tape becomes tensioned to a greater degree and during deceleration the tape becomes slacker due to a greater amount being fed through the feed rollers in comparison to the amount of advance of the workpiece by the transport mechanism.

Although these conditions are quite obvious, the known machines are not equipped with devices for correcting such conditions. As a result of this sort of inertia, with each variation of the machine's operating speed, there is no synchronization between the supply to the tape feed rollers and the mechanism for advancing the workpiece and, as the machine continues to operate, these discrepancies become more pronounced by being added to one another.

An object of the invention is to provide a device which is capable of detecting a discrepancy of the type described supra and immediately take the necessary steps to correct and compensate for the discrepancy.

SUMMARY OF THE INVENTION

The tape feed device for sewing machines, according to the invention, functions in timed relation to the mechanism for advancing a workpiece to which tapes are attached during the stitching operation and includes sensing elements for sensing the operating speed of the machine as well as the rate of advance of the workpiece relative to each revolution of said machine's main shaft.

A control unit having a microprocessor receives signals from the sensing elements and is effective in controlling a motor operatively connected to tape feed rollers so that the rollers are caused to rotate at a speed dictated by the control unit. A feedback response supplied to the control unit signals the actual values of rotation which the rollers are cuased to travel which enables the control unit to make the necessary adjustments for correcting possible differences present when the values of rotation are greater or less than those best suited for a particular sewing operation.

The means for sensing the operating speed of the machine includes a synchronizing member mounted on the end of the machine's main shaft and which is formed with gaps that form five teeth that provide ten leading and trailing edges that are disposed so as to operatively cooperate with a proximity sensor or phasing strobe. This arrangement delivers at each edge of the synchronizing member a pulse that is delivered to the control unit and, consequently, the same number of pulses per unit of time as the number of rotations of the machine.

The motor connected to the tape feed rollers includes a control disc having a substantial number of teeth about its peripheral edge with all defining leading and trailing edges and being operatively connected to the feed rollers by pre-selected transmission elements, rotation of said rollers is effected by a plurality of the edges of said control disc relative to each edge of the synchronizing member as sensed and dictated by the control unit.

Additionally, the control disc is operatively associated with a strobe for measuring elementary steps which detects the extent of advance by the rollers and transmits, by means of a feedback loop, this extent of advance so that it can be compared with the information received from the sensing elements. This control disc is also connected to a direction strobe that serves to check the direction of rotation of the motor.

The control unit includes at least two value setting means in the control unit for causing the power supply to the rollers to correspond to various values of the workpiece transport mechanism and a third setting means for varying the amount of tape supplied during the sewing cycle relative to the two value setting means.

Other features and advantages of the invention will become more fully apparent by reference to the appended claims and as the following detailed description proceeds in reference to the figures of drawings wherein:

DESCRIPTION OF THE PREFERRED EMBODIMENT

Figure 1:
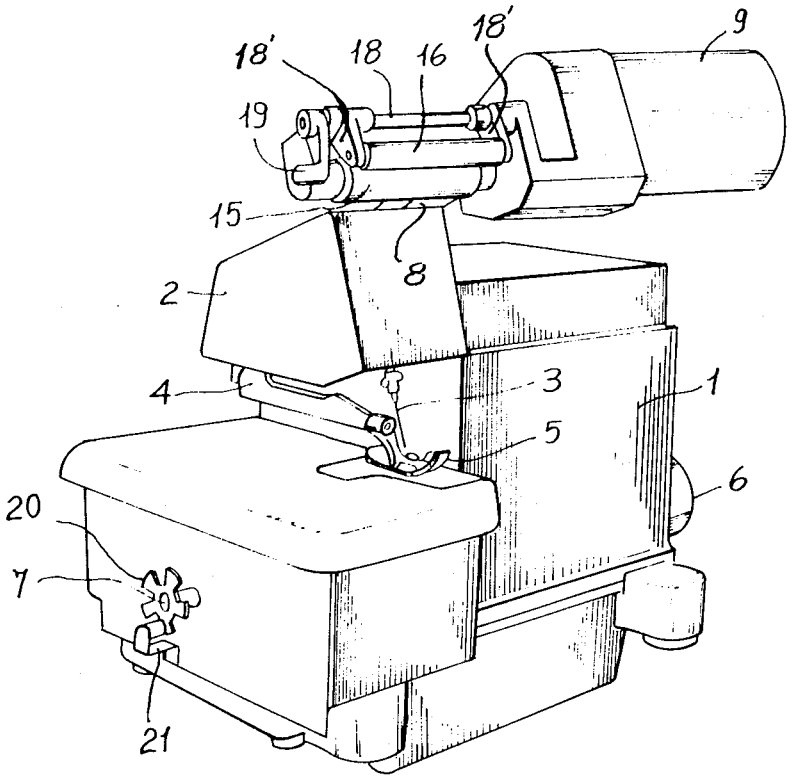
FIG. 1 is a perspective view of a sewing machine to which the device, according to the invention, has been applied.

Referring now to FIG. 1, a conventional sewing machine is shown and includes among its many parts a frame 1 with the usual arm 2 from which a stitching needle 3 projects in a downwardly direction. The arm 2 also has a support arm 4 mounted on the underside thereof which carries the machine's presser foot 5 that is disposed directly above the feed dog mechanism (not shown).

As shown in FIG. 1, a flywheel 6 projects from one end of the frame and is mounted on one end of the machine's main shaft 7 which, in a known manner, serves to drive various elements of the machine.

Figure 2:
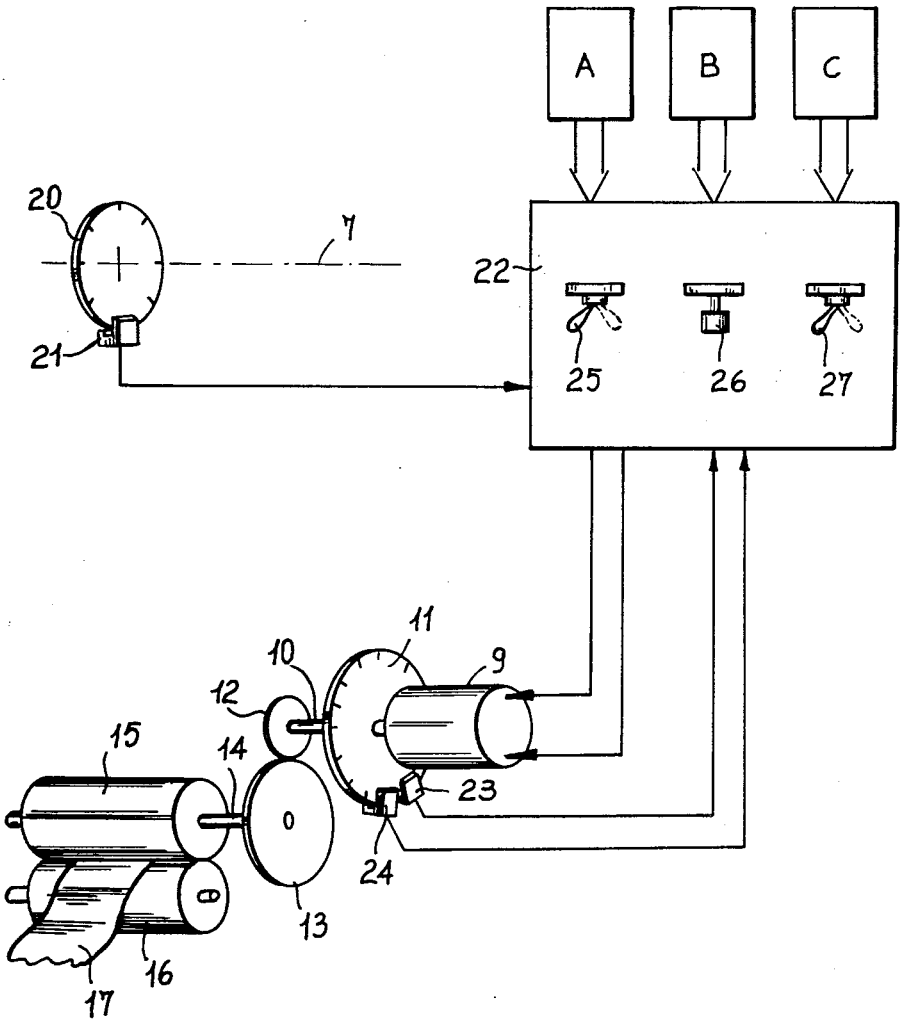
FIG. 2 is a view partially in perspective showing the various elements for effective rotation of the tape feed rollers.

A motor stand 8 extends upwardly from the arm 2 and serves to support a motor 9 which, as shown in FIG. 2, is provided with a shaft 10 having a control disc 11 and a pinion 12 assembled thereon. The pinion 12 is in driving relation with a gear member 13 fixed on a shaft 14 whereby a pre-selected transmission ratio is established between shafts 10 and 14. A feed roller identified by numeral 15 is assembled on shaft 14 and is disposed in operative association with a roller 16. Rotation of the rollers 15 and 16 effects advancement of a tape 17 disposed therebetween. As shown in FIG. 1, roller 16 is pivotally connected to a rod 18 by means of arms 18' and is continuously urged into contact with roller 15 by spring means (not shown). A lever 19 fixed on one end of the rod 18 provides a means whereby the roller 16 can be manually pivoted from contact with the roller 15.

The end of the main shaft 7 opposite the end which carries the flywheel 6 has a movement sensor assembly thereon which defines a synchronizing member 20 with five equally spaced teeth. The adjacent gaps between these five teeth provide ten edges which rotate with the main shaft 7 so that they sequentially move into operative association with a proximity sensor or phasing strobe 21. As each edge moves past the phasing strobe 21, a pulse is transmitted to a control unit 22 having a microprocessor that is effective in supplying the same number of pulses per unit time as the number of rotations of the main shaft of the machine.

The control unit when receiving these pulses is effective in controlling the motor 9 so that, through the transmission ratio provided by gears 12 and 13, it is capable of rotating the feed rollers 15 and 16 at a speed which causes the tape 17 to be advanced therebetween at a speed synchronized with the rate of advance of a workpiece by the feed dog mechanism.

Timing is accomplished by means of the control disc 11 which is provided with sixty teeth equally spaced about its periphery and the spaces between said teeth define one hundred twenty edges which sequentially travel into operative association with a strobe 23. The strobe 23 signals the passing of the leading and trailing edges of the teeth back to the control unit 22 via a feedback loop and provides the effective extent of tape advancement by the rollers in response to the pulse information supplied to the motor 9 and which gradually corrects differences between the signals supplied to the motor and those which have been effectively provided by the latter.

Expressed differently, the device, according to the invention, is capable of instantly detecting an error due to inertia and during the intermediate succeeding signal is able to correct the error. For example, with each 2 millimeter advance of a workpiece by the feed dog, the supply rollers have advanced 1.8 millimeters of tape but, during the succeeding signal for correction, 2 millimeters would not be supplied but rather 2.2 millimeters. If an error still exists during the next cycle and knowing that the correction signal had been given but that correction had not completely occurred, then the error will be remembered and an attempt made to eliminate it on the succeeding pulse; thus from one instant to the next, the errors due to inertia in the sysem are corrected.

The control disc 11 also rotates in operative association with a direction strobe 24 which is connected to the control unit 22 and serves to check the direction of rotation of the motor 9 in order to prevent its direction of rotation from being incorrect upon receiving a signal for correction.

As the device is not adapted to advance tape at a fixed rate, it is necessary that it be able to accommodate varying stitch lengths formed by the machine which from time to time are required during the sewing operation. Consequently, the control unit provides value setting means for causing the supply of tape to the feed rollers to correspond to the extent of workpiece advance provided by the feed dog mechanism. A first value setting means "A" is provided for normal feed which makes the amount of tape supplied equal to that required by the feed dog mechanism. A second value setting means "B" is provided for establishing predetermined values adapted for other types of garment manufacture; and a third value setting means "C" for temporarily introducing a fresh value for the feed within the field of the above first and second values. An example of this is that of being able to vary the amount of tape which is supplied at definite points in respect to the first as well as to the second value setting means. As shown in FIG. 2, a selector switch 25 is provided whereby it is possible to accomplish a prior selection of the supply to the feed rollers depending on the value set by the first and second value setting means. The central unit 22 also includes a pushbutton switch 26 which serves as a means for continuously supplying the rollers 15 and 16 while the button is held in its activated position. The purpose of a manually controlled continuous feed of the tape 17 being fed between the feed rollers permits a sufficient amount of the tape to be withdrawn so that the end can be inserted beneath the machine's presser foot 5. After an adequate amount of tape has been withdrawn, the operator simply releases the pushbutton switch and in so doing initiates the start of the sewing operation.

As shown in FIG. 2, a switch 27 is also included in the control unit 22 and serves to activate or deactivate the tape feed device.

With the microprocessor memory, the values of the elementary steps correspond to each of the ten edges of the synchronizing member 20 and are stored as a function of the stitch length being provided by the machine's feed dog mechanism.

Considering the transmission ratio between the gear members 12 and 13, the elementary values multiplied by 0.2 provide the values for the feeding of the tape 17 as a function of the machine's feed dog mechanism. When elastic strips are being fed to a workpiece requiring pleating, and knowing the amount of advance produced by the feed dog mechanism, a lesser degree of feed of the elastic strip will be performed by introducing a selected value into the setting means for the feed. This selected value produces a result whereby at each edge of the synchronizing member 20 there corresponds a given number of edges of the control disc 11 operatively associated with the motor 9 so that the sum of this number of edges multiplied by 0.2 provides a value for the feed of the elastic strips. This value corresponds to the amount which has been established since the ratio feed rollers with their transmission ratio produce an advancement of 0.2 millimeters at each elementary step.

The tape feed device, according to the invention, is adapted to feed tape or elastic strip in a programmed manner in the desired quantity relative to the length of stitches formed independently of the machine's operating speed and continuously in synchronization with the machine's feed dog mechanism.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A tape feed device for sewing machines having a rotatably driven main shaft and in which a workpiece is advanced beneath the machine's presser foot by its feed dog mechanism in timed relation to the feeding of tape thereto, said feed device comprising:

(a) means mounted on the machine for sensing its operating speed and the rate of advance of a workpiece beneath the presser foot and generating pulses representative of the operating speed and rate of advance sensed;

(b) a control unit having a microprocessor for receiving the pulses transmitted by said sensing means;

(c) tape feed rollers mounted on the machine including a drive motor operatively connected to said rollers for rotating said rollers at speeds corresponding to the number of pulses delivered by said sensing means to said control unit; and (d) means operatively connected to said drive motor for generating pulses representative of the speed of rotations of said rollers and transmitting these pulses back to said control unit for comparison with the pulses representing machine operating speed to effect minor changes in the speed of said drive motor.

2. A tape feed device according to claim 1, wherein said sensing means includes:

(a) a synchronizing member (20) mountd on the machine's main shaft and including a plurality of teeth disposed about its periphery; and (b) a phasing strobe (21) mounted on the machine adjacent said synchronizing member for sensing the leading and trailing edges of its teeth and to transmit a pulse to said control unit for each edge sensed so as to provide the same number of pulses per unit of time as the number of rotations of the main shaft.

3. The tape feed device according to claim 2, wherein said drive motor includes:

(a) a control disc (11) operatively connected therewith having a plurality of teeth defining leading and trailing edges;

(b) a pair of gear members (12,13) interconnecting said motor and control disc with said tape feed rollers (15,16) defining a transmission ratio for causing said rollers to rotate a distance governed by a predetermined number of edges of said control disc (11) for each edge of the synchronizing member (20) as sensed and dictated by said control unit.

4. The tape feed device according to claim 3, herein said control disc is operatively associated with a strobe (23) for measuring elementary steps which provide the actual extent of rotation of the tape feed rollers that is returned to said control unit by said transmitting means.

5. The tape feed device according to claim 4, wherein said control disc (11) is operatively associated with a direction strobe (24) for checking the correct direction of rotation of said motor (9).

6. The tape feed device according to claim 1, wherein said control unit (22) includes:

(a) at least two setting means for causing the power supply to the feed rollers to correspond to various values of the workpiece advancing mechanism; and (b) a third setting means for temporarily introducing an additional amount of tape within the control of said two setting means.

* * * * *